US008782963B2

(12) United States Patent
Derreumaux et al.

(10) Patent No.: US 8,782,963 B2
(45) Date of Patent: Jul. 22, 2014

(54) MOLDED RIDGE TILE MADE OF BITUMEN IMPREGNATED CELLULOSE, AND AN APPLICATION THEREOF

(71) Applicant: Onduline, Levallois Perret (FR)

(72) Inventors: Charles Derreumaux, Hem (FR); Melih Kamil, Istanbul (TR)

(73) Assignee: Onduline, Levallois Perret (FR)

( * ) Notice: Subject to any disclaimer, the term of this patent is extended or adjusted under 35 U.S.C. 154(b) by 0 days.

(21) Appl. No.: 13/849,599

(22) Filed: Mar. 25, 2013

(65) Prior Publication Data

US 2013/0255164 A1 Oct. 3, 2013

(30) Foreign Application Priority Data

Mar. 27, 2012 (FR) ..... 12 52752

(51) Int. Cl.
*E04D 3/40* (2006.01)
*E04D 3/38* (2006.01)
*E04D 1/36* (2006.01)

(52) U.S. Cl.
USPC ..... 52/57; 52/42; 52/465; 52/746.11; 454/364; 454/365

(58) Field of Classification Search
USPC ..... 52/90.1–90.2, 91.1–91.3, 80.1–80.2, 52/81.1, 81.4, 81.6, 198–199, 782.1, 698, 52/245, 96, 277, 461–465, 41–44, 94, 52/57–58, 53; 427/186; 454/364–365
See application file for complete search history.

(56) References Cited

U.S. PATENT DOCUMENTS 1,653,847 A * 12/1927 Greenstreet ..... 52/277
1,677,031 A * 7/1928 Kuehn ..... 52/277
1,855,357 A * 4/1932 Kuehn ..... 52/94

(Continued)

FOREIGN PATENT DOCUMENTS

BE 892 078 A1 5/1982
DE 297 09 933 U1 8/1997

(Continued)

OTHER PUBLICATIONS

French Search Report, dated Dec. 6, 2012, from corresponding French application.

*Primary Examiner* — Jeanette E. Chapman
(74) *Attorney, Agent, or Firm* — Young & Thompson

(57) ABSTRACT

A molded ridge tile (1) made of bitumen-impregnated cellulose for covering a roof, and a method of applying the ridge tile to the roof. The ridge tile has an elongate shape in the length direction and includes transversely a downwardly concave symmetrical central portion (2) that is extended laterally and symmetrically on either side by two plane flanges (3) sloping laterally downwards beside the central portion, the flanges being carried by two planes that intersect with a downwardly facing internal angle between the flanges, the flanges being designed to be applied flat against two flat slopes of an upside-down V-shaped roof along the angular connection between the slopes, the slopes defining between them a determined ridge angle. In the absence of deformation stress, the internal angle between the flanges is 106 degrees±10 degrees, i.e. a flange angle relative to the horizontal of 37 degrees±5 degrees.

16 Claims, 4 Drawing Sheets

(56) References Cited

U.S. PATENT DOCUMENTS

| | | | | |
|---|---|---|---|---|
| 3,491,573 | A * | 1/1970 | Tennison, Sr. | 72/348 |
| 4,322,924 | A * | 4/1982 | Cooper | 52/57 |
| 5,605,018 | A * | 2/1997 | McElderry et al. | 52/57 |
| 5,928,764 | A * | 7/1999 | Costi | 428/182 |
| 2011/0151170 | A1 | 6/2011 | Grubka et al. | |
| 2011/0225907 | A1 * | 9/2011 | Chang | 52/198 |
| 2013/0263526 | A1 * | 10/2013 | Thomas et al. | 52/57 |

FOREIGN PATENT DOCUMENTS

| | | | |
|---|---|---|---|
| GB | 2 138 050 | | 10/1984 |
| GB | 2138050 | A * | 10/1984 |
| GB | 2210072 | A * | 6/1989 |
| GB | 2338968 | A * | 1/2000 |
| WO | 2005/095730 | A1 | 10/2005 |
| WO | 2006/108231 | | 10/2006 |

* cited by examiner

MOLDED RIDGE TILE MADE OF BITUMEN IMPREGNATED CELLULOSE, AND AN APPLICATION THEREOF

FIELD OF THE INVENTION

The present invention relates to a molded ridge tile made of bitumen-impregnated cellulose and to its application to covering a roof. The field of the invention is that of fabricating roofing elements and building buildings that include a roof.

BACKGROUND OF THE INVENTION

Roofing elements made of bitumen-impregnated cellulose fibers have been known for many years and they serve to cover the roofs of buildings in a manner that is simple and inexpensive. These elements are relatively rigid and the deformations they can accept without risk of cracking, tearing, or breaking are of relatively limited amplitude. With elements that are large corrugated sheets, that does not present a problem since they are designed to be placed on flat slopes. However, some such roofing elements, in particular ridge tiles and hip tiles, are designed to cover particular zones of the roof that have shapes that are not plane. Such ridge or hip tiles are elongate one-piece elements in the form of an upside-down central gutter between two lateral plane flanges, the flanges being arranged on either side.

Along the edges of a roof, and in particular along the ridge line, the angle between the two slopes on either side of the edge may vary from one building to another. In order to provide effective rain-proofing and insulation, covering elements and in particular their side flanges need to be applied relatively accurately on the roof and its adjacent/underlying roofing element. If attempts are made to deform the roofing elements considerably so that it is properly applied against the roofing, there is a high risk of cracking, breaking, tearing, or fissuring either immediately or later on. Such faults generally appear along the top of the ridge tile and along the lines connecting the central gutter to the lateral flanges.

Thus, document US 2011/0151170 discloses shingle plane roofing plates both for the slope and for the ridge of a roof, which plates are based on a bitumen-covered mat of fibers. Cuts that are continuous and cuts that are discontinuous in the form of dotted or dashed lines are made in the plates so as to enable them to be separated into a plurality of portions. The plates may be placed on the ridge of the roof by being folded, without the conditions necessary for doing so and the consequences of doing so being specified.

With ridge tiles, it is therefore necessary to make different kinds of ridge tile that differ from one another by the internal angle between the flanges of the tile when it is not subjected to deformation. The internal angle between the flanges of the tile corresponds to the downwardly facing internal angle along the line of intersection between the two planes for carrying the lateral flanges of the tile, which flange must be applied against the roof and/or the underlying roofing elements already placed on the roof.

This leads to increased fabrication and storage costs and to a risk of error when installing the roofing elements if the kind of tile is not appropriate for the roof.

Devices are known that are for placing on the ridge of a roof and that are made of other materials, and in particular out of metals. By way of example, document GB 2 138 050 describes a ridge-covering system that is made up of two covering elements, an internal element having plane lateral flanges and an external element that is placed on the internal elements. Those elements are made of metals. Transverse ribs

7 are made on the internal element by stamping the metal. The lateral flanges are connected to the central portion of the internal element along an angled connection line. The angle of the lateral flanges of the internal element relative to the horizontal is 30 degrees outwards. Finally, the internal element is pierced through the thicknesses of its central portion for ventilation purposes. Document WO 2006/108231 describes a terminal element for a roof ridge. That element has front and lateral plane flanges that are pivotable about a rounded central portion in order to match the angles of different roofs. The lateral flanges are connected to the central element along respective connection lines and via respective pivot hinges enabling the flanges to be pivoted. In a variant (FIG. 7), the pivot is replaced by an angular fold line (712, 716) of the terminal element. Nevertheless, those documents relate to roofing elements made of materials other than those of the molded roof tiles made of bitumen-impregnated cellulose of the invention and they therefore give no information about the behavior of such roof tiles and their potential for being adapted. Furthermore, they are structures of different shapes and in particular they have angular connection lines between their various portions.

The Applicant has found that in spite of the relative rigidity of molded roofing elements made of bitumen-impregnated cellulose, the amplitude through which it is possible for the element to deform under stress without risk of it being deteriorated or destroyed can be greatly increased by giving the roofing element a shape of a particular type. Such deterioration or destruction corresponds to the appearance of cracks, tears, or breaks in the short or medium term. Generally, the behavior under stress is determined under determined experimental conditions, in particular climatic cycling in which temperature and moisture are varied.

For a roof tile, making an element with a particularly closed internal angle between the flanges enables the elements to be used over a wide range of roof ridge angles, which is not possible with conventional ridge tiles in which the internal angle between the flanges is much wider open. In addition, the particular shapes of the various portions of the element can also assist in improving the performance of the element in terms of adaptability.

SUMMARY OF THE INVENTION

Thus, the invention firstly provides an application of a molded ridge tile made of bitumen-impregnated cellulose for covering a roof, the tile being generally in the form of a section member having an elongate vertical plane of symmetry and comprising transversely a downwardly concave central portion extended laterally and symmetrically on either side by two downwardly sloping plane flanges so as to form an internal angle $\alpha$ between the flanges as measured on the concave side of the central portion, in which the central portion of the tile is placed to cover a roof ridge defined between two slopes that form between them a ridge angle $\gamma$, the flanges being applied flat against the two slopes of the roof.

In this application, starting from a free configuration in which the ridge tile is not subjected to any stress and in which the internal angle between the flanges has a determined value, the tile is applied by deforming its internal angle between the flanges without deteriorating or destroying the tile, to a range of ridge angles $\gamma$ extending from 90 degrees to 163 degrees.

For a roof that is symmetrical, this corresponds to a range of slope angles (equals angle of the slope relative to the horizontal) extending approximately from a maximum of 45 degrees, i.e. 100%, to 16.7 degrees, i.e. 30%, and in a variant from 45 degrees of 8.5 degrees, i.e. 15%.

Preferably, the range of ridge angles extends from 90 degrees to 147 degrees.

In a particular version of this application, in the absence of deformation stress, the internal angle α between the flanges lies in the range 116 degrees to 96 degrees (=106 degrees±10 degrees), i.e. a flange angle β relative to the horizontal lying in the range 42 degrees to 32 degrees (=37 degrees±5 degrees).

The invention also provides a molded ridge tile made of bitumen-impregnated cellulose, the tile being of elongate shape in a length direction, and comprising transversely a downwardly concave symmetrical central portion that is extended laterally and symmetrically on either side by two plane flanges sloping laterally downwards beside the central portion, said flanges being carried by two planes intersecting at a downwardly facing internal angle between the flanges, the flanges being for applying flat against two flat slopes of an upside-down V-shaped roof along the angled connection between said two slopes, said two slopes defining between them a determined ridge angle.

In this invention, in the absence of deformation stress, the internal angle α between the flanges lies in the range 116 degrees to 96 degrees (=106 degrees±10 degrees), giving a flange angle β relative to the horizontal lying in the range 42 degrees to 32 degrees (=37 degrees±5 degrees).

The term "ridge tile" should be understood broadly as meaning a roofing element that is to cover a change of slope line, in particular a roof ridge, but also a roof slope that changes its angle of slope, in which case the element is similar to a hip tile.

In various embodiments of the invention, the following means may be used singly or in any technically feasible combination:

- the internal angle between the flanges is 106 degrees±10 degrees;
- the internal angle between the flanges is 106 degrees±5 degrees;
- the internal angle between the flanges is 106 degrees, i.e. a flange angle relative to the horizontal of 37 degrees;
- on either side of the central portion, the connection zone between the central portion and the corresponding flange includes circularly arcuate rounding;
- the circularly arcuate rounding of the connection zone between the central portion and the corresponding flange is outwardly concave;
- the central portion includes a circularly arcuate top segment that is extended laterally on either side by two sloping straight segment extending to the connection zone;
- the circularly arcuate top segment has an inside radius of 35 millimeters (mm) and a projected amplitude on a horizontal line of about twice 31 mm;
- the circularly arcuate rounding of the connection zone between the central portion and the corresponding flange has an outside radius of 15 mm;
- each of the flanges includes along its length and within its width a flat embossed strip that is raised relative to the flange;
- the embossed strip extends over the entire length of the tile;
- the embossed strip is for receiving fastener means for fastening the tile to the roofing elements and to the roof, said fastener means being selected from nails, spikes, and screws;
- the central portion includes transverse ribs, said ribs being arranged in pairs;
- the ribs are raised zones of the tile;
- the two ends of the ribs terminate before or immediately at the beginning of the circularly arcuate rounding of the connection zone between the central portion and the corresponding flange;
- the tile has a width of about 175 mm, a length of about 1060 mm, a height of 79 mm, a thickness of about 2.5 mm, and the flanges have a width of about 52 mm;
- the tile has a width of about 175 mm;
- the tile has a length of about 1060 mm;
- the tile has a height of about 79 mm;
- the tile has a thickness of about 2.5 mm;
- the flanges have a width of about 52 mm;
- the two embossed strips are raised by about 1.5 mm;
- the embossed strips have a width of about 25 mm;
- the embossed strips terminate at about 13 mm from the circularly arcuate rounding of the connection zone between the central portion and the corresponding flange;
- the embossed strip terminates at about 14 mm from the free end of the flange;
- the tile has four pairs of ribs;
- the width of the rib corresponding to a measurement in the length direction of the tile is about 15 mm;
- in a pair, the two ribs are spaced apart between two adjacent edges by 30 mm as measured in the length direction of the tile;
- each of the lengthwise ends of the tile has a pair of ribs;
- in an end pair of ribs of the tile, the first rib in the pair has an edge at a distance of 10 mm from the end of the tile;
- the blank of the tile is obtained by a parallel and continuous fabrication method in which a strip of cellulose is molded with a continuous travel method for forming parallel lines of tiles in the strip, the strip then being cut up into segments of determined length, the segments then being impregnated with hot bitumen, and the impregnated segments then being cut apart to obtain individual tiles;
- the blank of the tile is obtained by a discontinuous method of concentrating and hot-molding a cellulose pulp under pressure with fluids being sucked out from a mold having a shape and a countershape, said blank subsequently being impregnated hot with bitumen; and
- hot-impregnation with bitumen is performed on a dried cellulose blank.

BRIEF DESCRIPTION OF THE DRAWINGS

Although not limited thereto, the present invention is exemplified below in the following description of embodiments given with reference to.

DETAILED DESCRIPTION OF THE INVENTION

Figure 8:
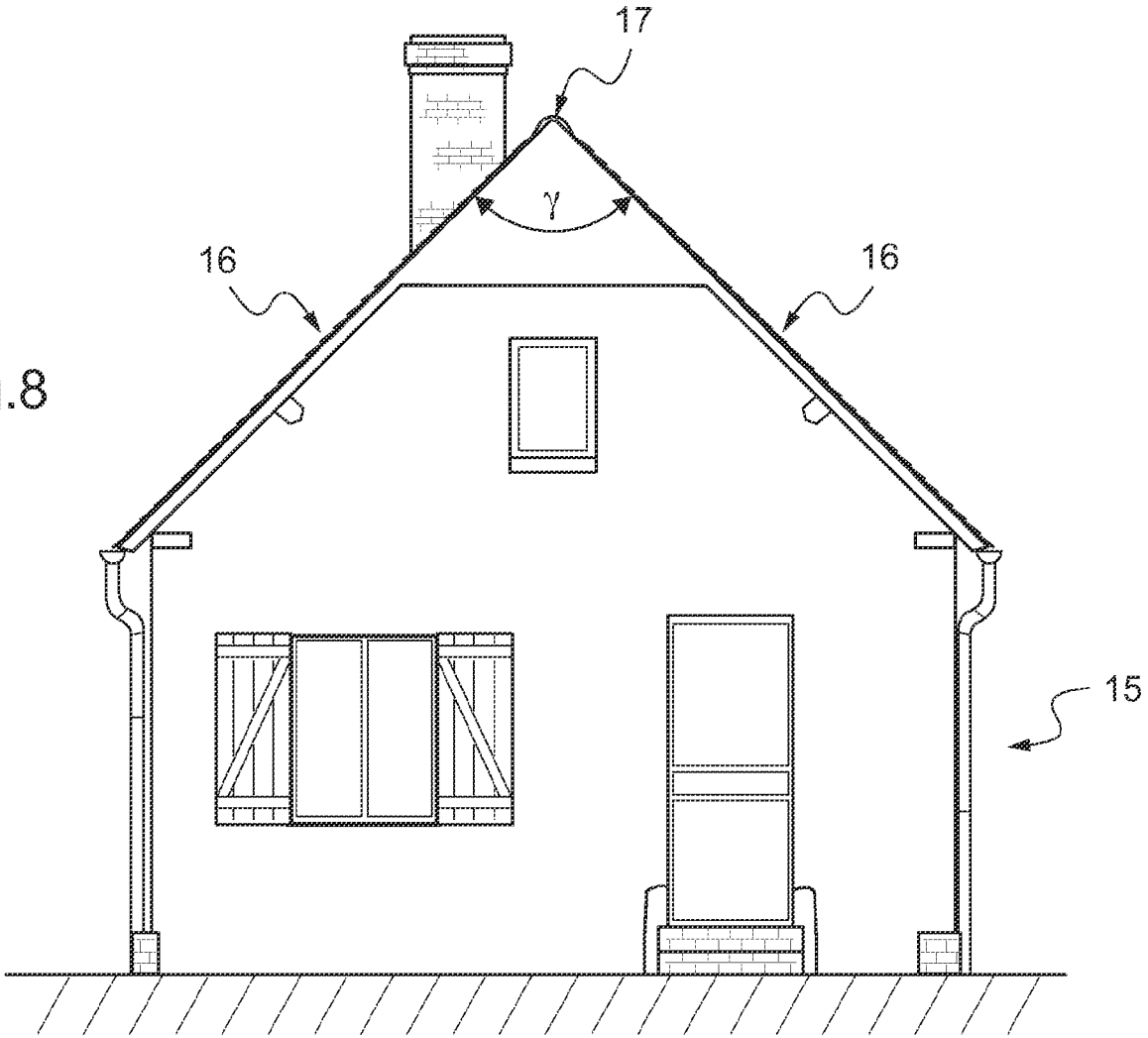
FIG. 8 which shows a dwelling having a roof with a ridge line.

Typically, in a conventional ridge tile and in the absence of deformation stress, the internal angle α between the flanges is about 146 degrees, which corresponds to the flanges sloping at 17 degrees relative to the horizontal. In the ridge tile of the invention, this internal angle between the flanges is much smaller, it then being said that the ridge tile is more closed than a conventional ridge tile. In the example described below, this internal angle α between the flanges, in the absence of deformation stress, is about 106 degrees, which corresponds to the flanges being inclined at an angle β of 37 degrees relative to the horizontal. FIG. 8 shows a dwelling in which the roof has two slopes 16 that meet along a ridge line 17. The ridge angle along the ridge line between the two slopes is marked γ in FIG. 8.

Figure 1:
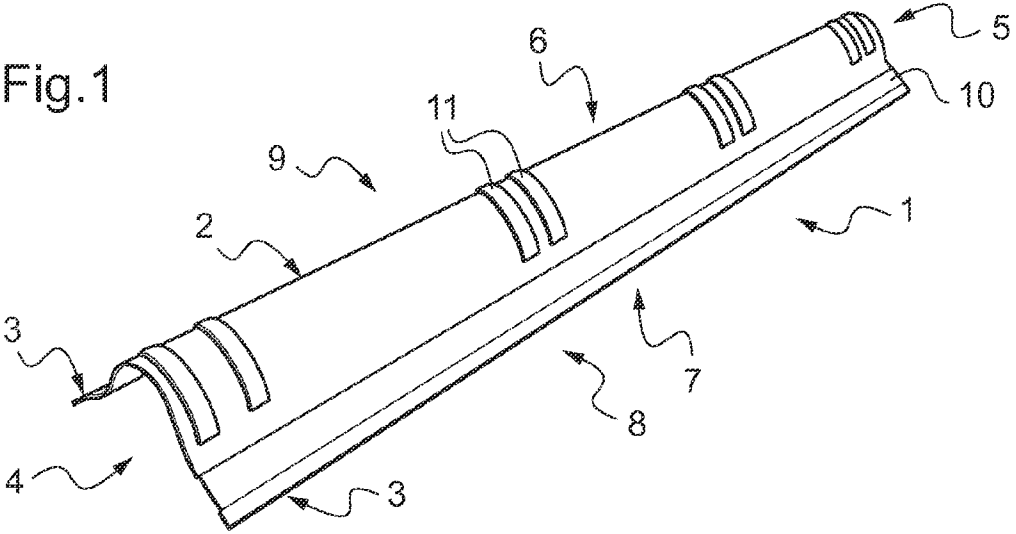
FIG. 1 which is a perspective view of a ridge tile of the invention.
Figure 2:
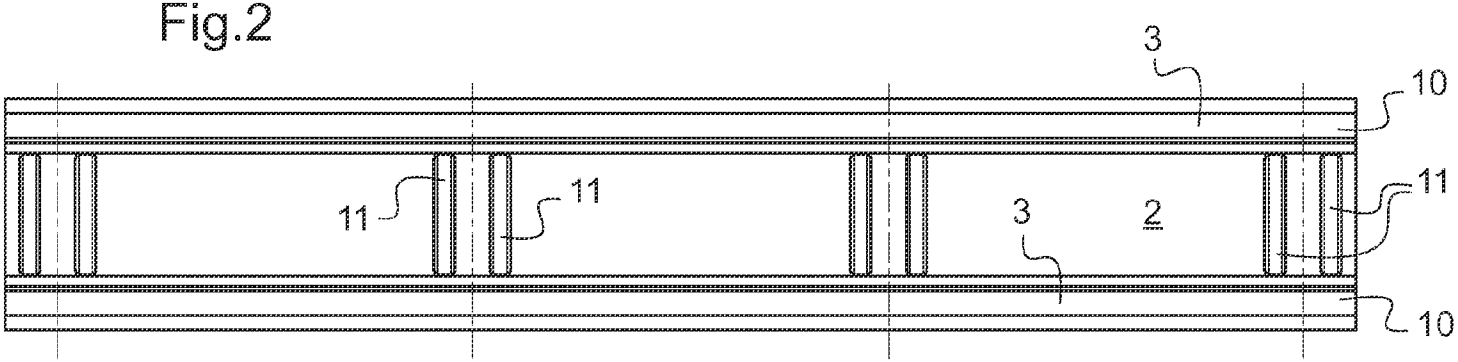
FIG. 2 which is a plan view of the FIG. 1 tile.
Figure 3:
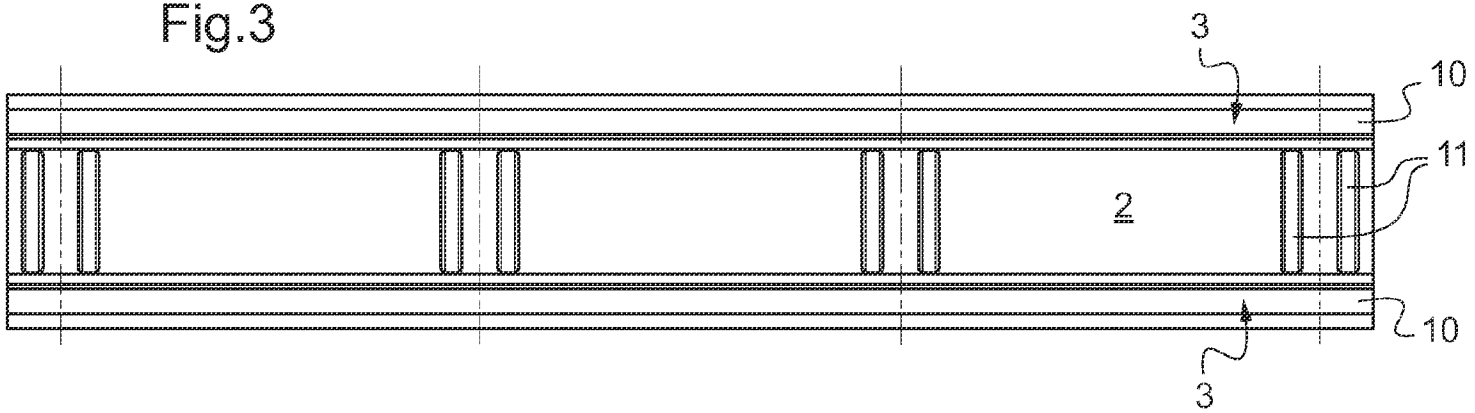
FIG. 3 which is a view of the underside of the FIG. 1 tile.
Figure 4:
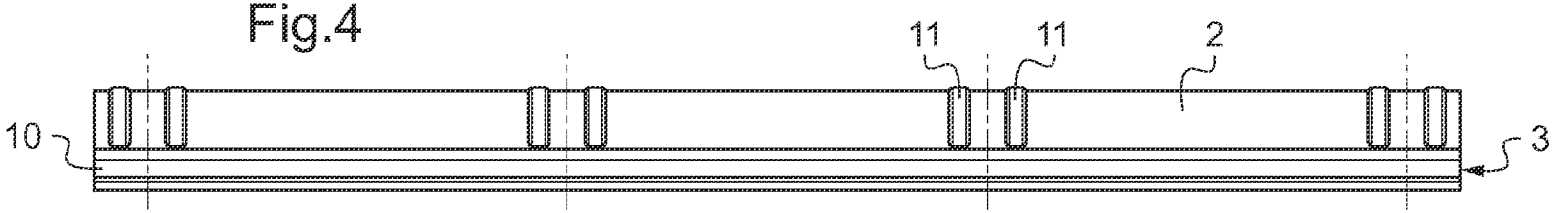
FIG. 4 which is a side view from the front of the FIG. 1 tile.
Figure 5:
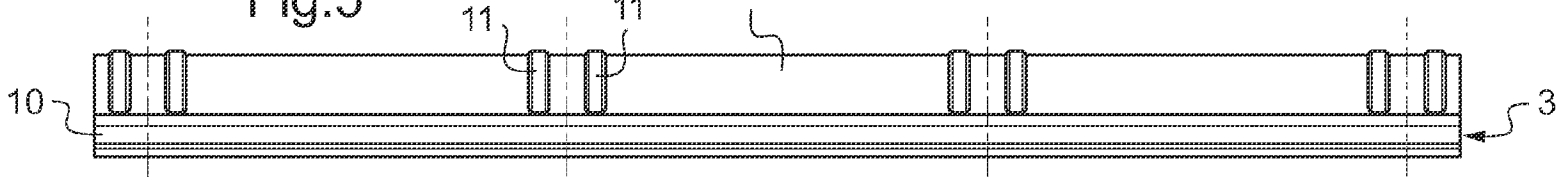
FIG. 5 which is a side view from behind of the FIG. 1 tile.

A ridge tile is a symmetrical elongate element having a downwardly concave symmetrical central portion 2 forming an upside-down gutter and extended laterally and symmetrically on either side by two plane flanges 3 that slope laterally downwards from the central portion. In FIG. 1, the left axial/transverse end 4 of the ridge tile is placed towards the observer and the other or right axial/transverse end 5 is at its opposite end. The top 6 of the ridge tile is towards the top in FIG. 1, and the bottom 7 of the ridge tile is towards the bottom of FIG. 1. The front side 8, which corresponds to a first lateral side along the length of the ridge tile, is towards the observer in FIG. 1, and the rear side is on the other side of the ridge tile.

A raised, linear, and flat embossed strip 10 runs along each flange 3. Ribs 11 are arranged in pairs transversely along the central portion 2 of the ridge tile. The left or right end pairs of ribs are designed to cover one another when the ridge tiles are put into place, with this thus being done by the tiles overlapping in part at their ends.

FIGS. 2 to 5 show the essentially symmetrical structure of the ridge tile more clearly.

Figure 6:
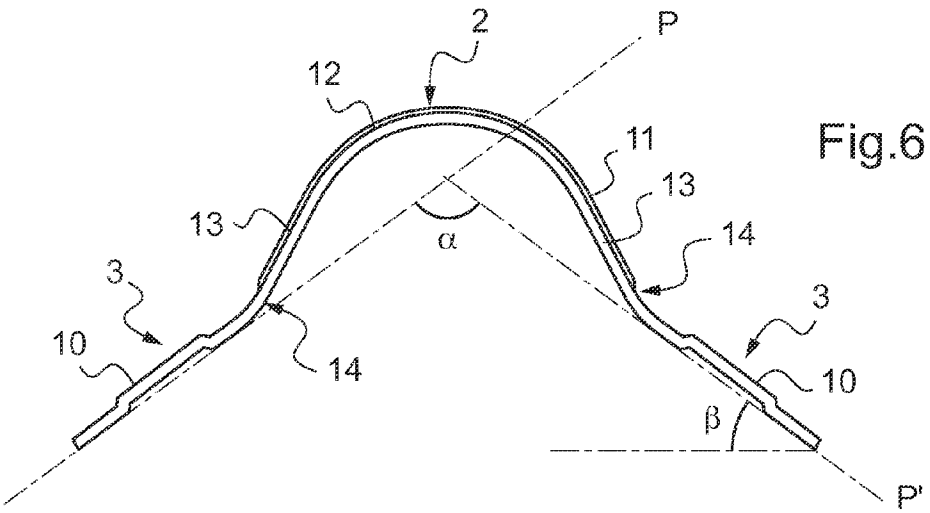
FIG. 6 which is an axial/transverse view from the right-hand end of the FIG. 1 tile.
Figure 7:
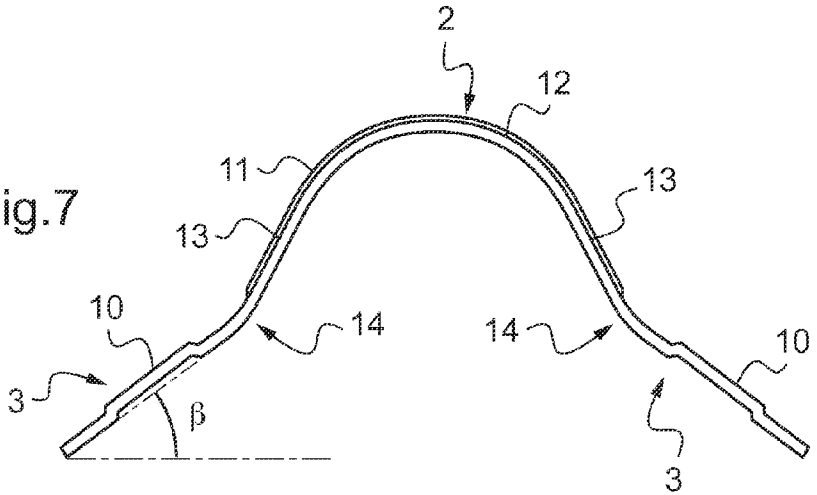
FIG. 7 which is an axial/transverse view of the left-hand end of the FIG. 1 tile.

FIGS. 6 and 7 show more clearly the structure of the central portion 2, which is made up of a circularly arcuate top segment 12 that is downwardly concave and that is extended laterally, on either side, by two straight/flat segments 13. The central portion 2 is connected to a corresponding flange by a connection zone 14 between the straight segments 13 and the corresponding flange 3. This connection zone has circularly arcuate rounding 14. The circularly arcuate rounding 14 further improves the behavior of the ridge tile when subjected to deformation under stress and makes it possible to increase further the amplitude of the deformation under stress of the internal angle between the flanges without running the risk of deteriorating/destroying the tile.

The ridge tile of the invention may typically be installed without risk of deterioration or destruction on roofs presenting a range of ridge angles (equal to the downwardly-facing internal angle between the two slopes of the roof) extending from 90 degrees to 146.6 degrees, and preferably up to 163 degrees.

In terms of the slope angle of one of the slopes (equal to the angle of the slope relative to the horizontal), for a roof that is symmetrical, this corresponds to the following limits for the slope angle: 45 degrees, i.e. 100%; and 16.7 degrees, i.e. 30%, and preferably as far as 8.5 degrees, i.e. 15%. The relationship between the slope angle, measured relative to the horizontal, and its expression as a percentage is given by the tangent of the angle.

As an example of determined experimental conditions suitable for verifying the behavior under stress of the ridge tile, consideration may be given to test method TS EN 537 7.4.4. The implementation of this method is summarized briefly below:

installing the ridge tile on a rigid model of a roof ridge having a determined ridge angle, and fastening it thereto by spikes or screws passing through the flanges;

placing the ridge tile in a bath of demineralized water for absorption;

extracting the ridge tile and placing it in a freezing chamber at a temperature of −20° C. for freezing; and extracting the ridge tile and placing it in a ventilated oven at a temperature of +50° C., for heating.

These various absorption, freezing, and heating steps are repeated a certain number of times with determined individual durations, and in the end the tile is examined to determine whether there has been any deterioration or destruction that might appear in particular in the form of cracks, breaks, tears, or fissures.

It can be understood that the values given in the description of this example ridge tile are approximate and indicative, and that they may differ depending on the specific models that are fabricated. Likewise, the ridge tile of the invention may be applied equally well to a roof in which the slopes slope at identical angles, i.e. having a symmetrical ridge, and roofs in which the slopes slope at different angles, i.e. a roof having an asymmetrical ridge. Finally, the ridge tile of the invention may also be used as a hip tile.

Naturally, the present invention is not limited to the particular embodiments described above, but extends to any variants and equivalents that are in accordance with the spirit of the invention. Thus, it can be understood that the invention may be varied in numerous other ways without thereby going beyond the ambit defined by the description and the claims.

The invention claimed is:

1. A method for covering a roof, comprising:

applying a molded ridge tile (1) made of bitumen-impregnated cellulose to the roof, the tile being generally in a form of a section member having an elongate vertical plane of symmetry and comprising transversely a downwardly concave central portion (2) extended laterally and symmetrically on either side by two downwardly sloping plane flanges (3) so as to form an internal angle (α) between the flanges as measured on the concave side of the central portion, in which the central portion of the tile is placed to cover a roof ridge defined between two slopes (16) that form between them a ridge angle (γ), the flanges being applied flat against the two slopes of the roof, wherein on each side of the central portion, the connection zone between the central portion and the corresponding flange includes circularly arcuate rounding (14), and starting from a free configuration in which the ridge tile is not subjected to any stress and in which the internal angle between the flanges has a determined value, the tile is applied by deforming the internal angle between the flanges without deteriorating or destroying the tile, to a range of ridge angles (γ) extending from 90 degrees to 163 degrees, and in the absence of deformation stress, the internal angle between the flanges lies in a range 116 degrees to 96 degrees, so as to give a flange angle (β) relative to the horizontal that lies in a range of 42 degrees to 32 degrees.

2. The method according to claim 1, wherein the internal angle (α) between the flanges is 106 degrees, and the flange angle (β) relative to the horizontal is 37 degrees.

3. The method according to claim 1, wherein the central portion includes a circularly arcuate top segment (12) that is extended laterally on either side by two sloping straight segments (13) extending to the connection zone.

4. The method according to claim 3, wherein the circularly arcuate top segment (12) has an inside radius of 35 mm and a projected amplitude on a horizontal line of about twice 31 mm.

5. The method according to claim 1, wherein each of the flanges (3) includes along its length and within its width a flat embossed strip (10) that is raised relative to the flange.

6. The method according to claim 1, wherein the central portion (2) includes transverse ribs (11), said ribs being arranged in pairs.

7. The method according to claim 1, wherein the ridge tile has a width of about 175 mm, a length of about 1060 mm, a height of about 79 mm, a thickness of about 2.5 mm, and the flanges have a width of about 52 mm.

8. The method according to claim 1, wherein a shape of the tile is obtained by a parallel and continuous fabrication method in which a strip of cellulose is molded with a continuous travel method for forming parallel lines of ridge tile shape in the strip, the strip then being cut up into segments of determined length, the segments then being impregnated with hot bitumen, and the impregnated segments then being cut apart to obtain individual tiles.

9. A molded ridge tile (1), comprising:

bitumen-impregnated cellulose of elongate shape in a length direction, and transversely a downwardly concave symmetrical central portion (2) that is extended laterally and symmetrically on either side by two plane flanges (3) sloping laterally downwards beside the central portion, said flanges being carried by two planes (P, P') intersecting at a downwardly facing internal angle ($\alpha$) between the flanges, the flanges being configured for applying flat against two flat slopes of an upside-down V-shaped roof along the angled connection between said two slopes, said two slopes defining between them a determined ridge angle, the ridge tile being configured so that on each side of the central portion, the connection zone between the central portion and the corresponding flange includes circularly arcuate rounding (14), and that, in the absence of deformation stress, the internal angle ($\alpha$) between the flanges lies in a range of 116 degrees to 96 degrees, giving a flange angle ($\beta$) relative to the horizontal lying in a range of 42 degrees to 32 degrees.

10. The ridge tile according to claim 9, wherein the internal angle ($\alpha$) between the flanges is 106 degrees, and the flange angle ($\beta$) relative to the horizontal is 37 degrees.

11. The ridge tile according to claim 9, wherein the central portion includes a circularly arcuate top segment (12) that is extended laterally on either side by two sloping straight segments (13) extending to the connection zone.

12. The ridge tile according to claim 11, wherein the circularly arcuate top segment (12) has an inside radius of 35 mm and a projected amplitude on a horizontal line of about twice 31 mm.

13. The ridge tile according to claim 9, wherein each of the flanges (3) includes along its length and within its width a flat embossed strip (10) that is raised relative to the flange.

14. The ridge tile according to claim 9, wherein the central portion (2) includes transverse ribs (11), said ribs being arranged in pairs.

15. The ridge tile according to claim 9, wherein the ridge tile has a width of about 175 mm, a length of about 1060 mm, a height of about 79 mm, a thickness of about 2.5 mm, and the flanges have a width of about 52 mm.

16. The ridge tile according to claim 9, wherein a shape of the tile is obtained by a parallel and continuous fabrication method in which a strip of cellulose is molded with a continuous travel method for forming parallel lines of ridge tile shape in the strip, the strip then being cut up into segments of determined length, the segments then being impregnated with hot bitumen, and the impregnated segments then being cut apart to obtain individual tiles.

* * * * *